United States Patent [19]

Suzuki et al.

[11] 4,226,220

[45] Oct. 7, 1980

[54] IGNITION TIMING CONTROL SYSTEM FOR AN INTERNAL COMBUSTION ENGINE

[75] Inventors: Yukio Suzuki; Kunihiko Sato, both of Toyota, Japan

[73] Assignee: Toyota Jidosha Kogyo Kabushiki Kaisha, Toyota, Japan

[21] Appl. No.: 13,978

[22] Filed: Feb. 22, 1979

[30] Foreign Application Priority Data

Oct. 4, 1978 [JP] Japan ..... 53-135419[U]

[51] Int. Cl.[3] ..... F02P 5/04

[52] U.S. Cl. ..... 123/408

[58] Field of Search ..... 123/117 A, 117 R

[56] References Cited

U.S. PATENT DOCUMENTS

| | | | |
|---|---|---|---|
| 3,042,134 | 7/1962 | Majewski | 123/117 A X |
| 3,800,759 | 4/1974 | Cedar | 123/117 A |
| 3,905,342 | 9/1975 | Kobayashi et al. | 123/117 A X |
| 4,064,894 | 12/1977 | Ludwig | 123/117 A X |
| 4,159,013 | 6/1979 | Sawada et al. | 123/117 A |

*Primary Examiner*—Tony M. Argenbright

*Attorney, Agent, or Firm*—Finnegan, Henderson, Farabow, Garrett & Dunner

[57] ABSTRACT

Disclosed herein is a system for controlling an ignition timing of an internal combustion engine in its idle condition. A control chamber of a vacuum advancer for operating a distributor of the engine is connected, via a vacuum modulator valve formed as a double diaphragm mechanism, to a vacuum signal port formed in an intake passageway of the engine at a position downstream of a throttle valve in its idle position. The vacuum modulator is adapted to control the vacuum level at the control chamber of the advancer to be reversely proportional to the vacuum level at the vacuum signal port. Accordingly, a stable idle operation of the engine can be obtained.

8 Claims, 8 Drawing Figures

(a)
(PRIOR ART)
(b)
(PRESENT INVENTION)
ACTUAL ROTATIONAL SPEED DURING IDLE CONDITION (Va)
x10²
PREDETERMINED ROTATIONAL SPEED DURING IDLE CONDITION (Vr)
x10²
5
6
7
8
9
Δ
Δ'
Δ''

IGNITION TIMING CONTROL SYSTEM FOR AN INTERNAL COMBUSTION ENGINE

FIELD OF THE INVENTION

The present invention relates to a system for controlling an ignition timing of an internal combustion engine in its idle condition and for maintaining a sufficiently high rotational speed of the engine to effect a stable idle operation even when the load of the engine is high.

BACKGROUND OF THE INVENTION

In a conventional internal combustion engine of the spark ignition type, for obtaining a stable idle operation and for preventing "knocking", the degree of advance of an ignition timing during the idle condition is usually maintained to be small. Thus, the combustion efficiency during the idle condition is low. In this case, the rotational speed of the engine in the idle condition is apt to decrease due to the load of the engine which is generated when auxiliary units of the engine, for example, an alternator, a power steering mechanism or an air conditioning apparatus are operating. Due to such low rotational speed occurring during the idle condition, an "engine stall" and/or an "over-heating" condition will easily take place.

SUMMARY OF THE INVENTION

An object of the present invention is to provide a system for controlling an ignition timing of an internal combustion engine, which system can always maintain a sufficiently high rotational speed of the engine in its idle condition to insure a stable idle operation.

Another object of the present invention is to provide an improved system which can control the ignition timing of the engine in accordance with the load of the engine during its idle condition.

Another object of the present invention is to provide a vacuum modulator which can control an output vacuum level to be reversely proportional to an input vacuum level.

A further object of the present invention is to provide an internal combustion engine with an improved ignition timing control system which is capable of effecting a stabilized idle operation.

According to the present invention, an ignition timing control system is provided for an internal combustion engine which has an intake device provided with a throttle valve. The system comprises: a distributor; vacuum actuator means for operating the distributor; a vacuum source formed in the intake device at a position located downstream of the throttle valve in its idle condition; and vacuum modulator means which is responsive to vacuum at the vacuum source for generating a vacuum pressure in the vacuum actuator means, which pressure is reversely proportional to the vacuum pressure at the vacuum source. Thus, the degree of advance of the ignition timing increases in accordance with a decrease of the vacuum level at the vacuum source when the engine is operating under the idle condition. Therefore, a sufficiently high combustion efficiency is obtained for maintaining a high enough rotational speed of the engine to effect a stable idle operation, even when the load of the engine during the idle condition is high.

BRIEF DESCRIPTION OF THE ATTACHED DRAWINGS

DETAILED DESCRIPTION OF THE PREFERRED EMBODIMENTS

Figure 1:
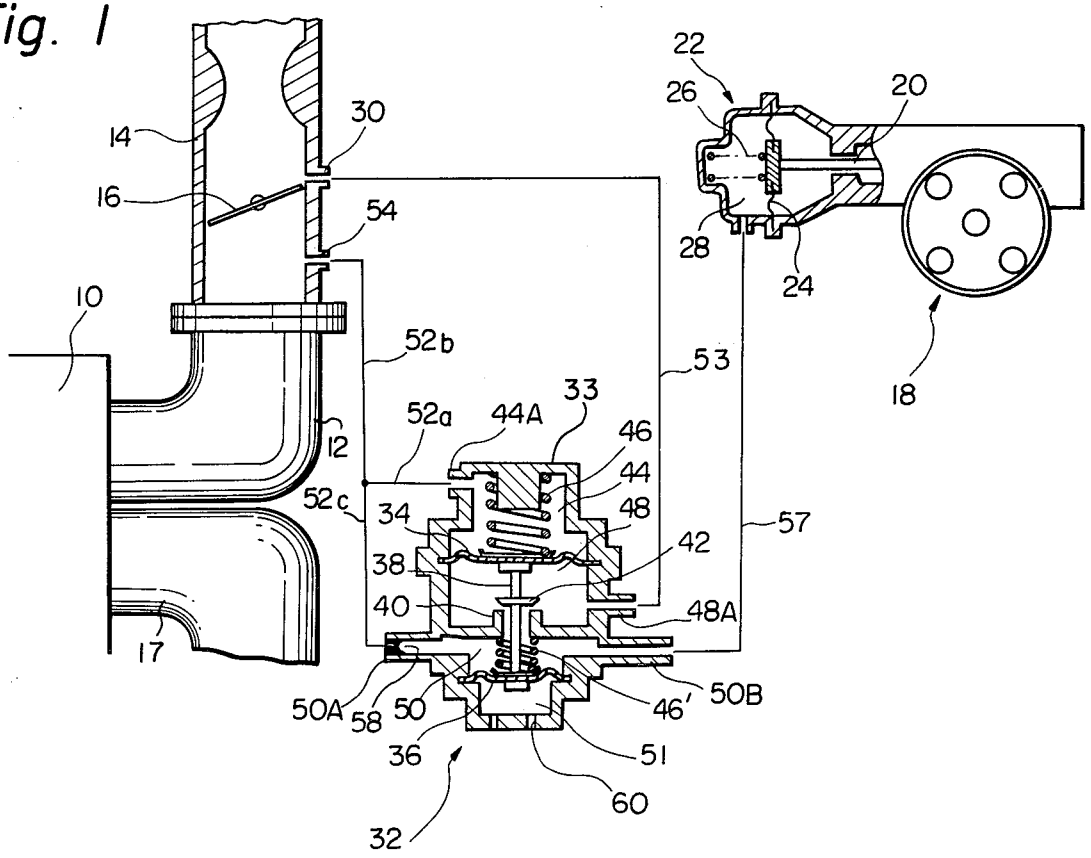
FIG. 1 is a schematic view of an ignition timing control system according to the present invention.

Referring to FIG. 1, a spark ignition type internal combustion engine is provided with an engine body 10, an intake manifold 12, a carburetor 14 in which a throttle valve 16 is arranged, an exhaust manifold 17, and a distributor 18. The distributor 18 causes the spark plugs (not shown) arranged in the engine body 10 to operate in a manner well known to those skilled in this art.

An actuator for operating the distributor, which is called a vacuum advancer, is generally shown by reference numeral 22. The vacuum advancer 22 is provided with a shaft 20 which is on one end thereof connected to a not shown breaker plate of the distributor 18. As the shaft 20 is moved further in the left-hand direction of FIG. 1, the ignition timing of the engine is advanced further. The other end of the shaft 20 is connected to a diaphragm 24. A spring 26 urges the diaphragm 24 for moving the shaft 20 in the right-hand direction of FIG. 1 to decrease the degree of advance of the ignition timing. Formed on one side of the diaphragm 24 is a vacuum chamber 28 into which a vacuum signal from the intake system of the engine is introduced for controlling a vacuum ignition timing of the engine.

In a prior art internal combustion engine, the chamber 28 of the vacuum advancer 22 is directly connected to a vacuum port (so-called advance port) 30 which is formed in the carburetor barrel at a position located slightly above the throttle valve 16 in its idle condition. Therefore, the chamber 28 of the vacuum advancer 22 is under a pressure which is close to atmospheric pressure when the throttle valve 16 is in its idle condition. Thus, the spring 26 causes the shaft 20 to be displaced in the right-hand direction and to thereby decrease the degree of advance of the ignition timing during the idle condition of the engine. The small degree of advance of the ignition timing makes it possible to obtain a stabilized idle operation and to prevent the generation of "knocking". However, such small degree of advance of the ignition timing causes the combustion efficiency to be decreased. As a result, the rotational speed of the engine during the idle condition is apt to be decreased when an additional load is applied to the engine. This additional load is generated when auxiliary units of the engine, such as an alternator, a power steering mechanism or an air conditioner, are in operation. Due to such low rotational speed of the engine during the idle condition, an undesirable phenomena, such as "engine stall" or "over heating" will easily occur.

In order to prevent the generation of such drawbacks, the present invention is further provided with means for controlling the ignition timing of the engine, i.e., the vacuum level in the chamber 28 of the vacuum advancer 22 in accordance with the load of the engine, so that a sufficiently high rotational speed of the engine is maintained during the engine idle condition to prevent the above-mentioned phenomena from occurring, as will now be described. In FIG. 1, reference numeral 32 designates a vacuum modulator valve device for controlling the vacuum level in the actuator 22 in accordance with the load of the engine during the idle condition. The vacuum modulator valve device 32 has a valve casing 33 and a pair of spaced-apart diaphragms 34 and 36 arranged across the interior of the casing 33. A partition wall defining a valve seat 40 is arranged between the diaphragms 34 and 36 which are connected to each other by means of a rod 38. A valve member 42 is fixedly secured to the rod 38 so that the valve member 42 faces the valve seat 40. Formed on one side of the diaphragm 34 remote from the valve seat 40 is a first chamber 44 in which a spring 46 is arranged for urging the diaphragm 34 downwardly. A second chamber 48 is formed between the diaphragm 34 and the valve seat 40. A third chamber 50 is formed between the valve seat 40 and the second diaphragm 36. Another spring 46' is arranged in the third chamber 50 for urging the diaphragm 36 downwardly. A fourth chamber 51 is formed on one side of the diaphragm 36 remote from the valve seat 40. The first chamber 44 receives a vacuum signal from the intake passageway of the engine for operating the modulator valve device 32, and has an input 44A connected, via vacuum pipes **52*a* and 52*b*, to another vacuum port 54 formed in the carburetor barrel at a position which is always located downstream of the throttle valve 16. The second chamber 48 stores air which is introduced into the third chamber 50 when the valve member 42 is detached from the valve seat 40, and has an input 48A connected to the advance port 30 via the vacuum pipe 53. The third chamber 50 produces a vacuum signal for operating the vacuum actuator 22 of the distributor 18. The third chamber 50 has an input 50A opened to the second vacuum port 54 via a vacuum pipe 52*c* and an output 50B connected, via a vacuum pipe 57, to the vacuum chamber 28 of the vacuum advancer 22. An orifice 58 is arranged in the input 50A for preventing the vacuum pressure in the engine intake passageway from being affected by the introduction of air from the second chamber 48 to the third chamber 50. It is preferable to provide the orifice 58 with such a dimension that air can pass therethrough at a rate of 1000 to 3000 cc/min., when the pressure difference is 500 mmHg. The fourth chamber 51 is always opened to the atmosphere via openings 60 formed in the valve casing 33**.

The operation of the modulator valve device 32 will now be described.

Idle Condition

When the engine is operating under an idle condition, the advance port 30 is always located above the throttle valve 16 as is shown in FIG. 1. Thus, the advance port 30 is under a pressure which is close to atmospheric pressure, and therefore serves to supply air into the second chamber 48 of the vacuum modulator 32. Since the second port 54 is located downstream of the throttle valve 16, the port 54 is under a vacuum pressure. Therefore, a vacuum signal from the port 54 is transmitted into the first chamber 44 via the vacuum pipes **52*a* and 52*b*. The vacuum signal is also transmitted into the third chamber 50 via the vacuum pipes 52*b* and 52*c*. When the load of the engine during the idle condition is low, the vacuum level at the second port 54 is as high as $x_1$ shown in FIG. 2A. In this case, the vacuum level in the first chamber 44 of the modulator 32 is high enough to cause the rod 38 to be displaced upwardly against the force of the springs 46 and 46'. Thus, the valve member 42 is detached from the valve seat 40, thereby allowing the air in the second chamber 48 to be introduced into the third chamber 50. Due to the introduction of air into the third chamber 50, the vacuum level in this chamber 50, which communicates with the vacuum chamber 28 of the vacuum advancer 22 via the vacuum pipe 57, is as low as $y_1$ shown in FIG. 2A even if the vacuum level in the vacuum port 54 is as high as $x_1$. Due to the low vacuum level in the vacuum chamber 28, the spring 26 causes the shaft 20 to move in the right-hand direction in FIG. 1**, so that the degree of advance in the ignition timing, when the load of the engine in its idle condition is low, is as small as that of Ra shown in FIG. 2B.

Figure 2A:
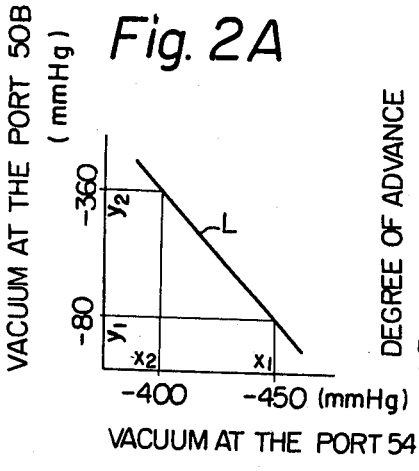
FIG. 2A is a graph showing the relationship between the vacuum level at the port 54 and the vacuum level at the port 50B.

When the auxiliary units, such as an alternator, a power steering mechanism or an air conditioner, are operated during the idle condition of the engine, the load of the engine increases so that the vacuum level in the second port 54, which communicates with the first chamber 44 of the modulator 32, via the vacuum pipes **52*b* and 52*a*, becomes as small as $x_2$ shown in FIG. 2A. Thus, the springs 46 and 46' cause the diaphragm to move downwardly so that the valve member 42 is rested on the valve seat 40. Therefore, the second chamber 48 is disconnected from the third chamber 50 to stop air from being introduced into the third chamber 50 from the second chamber 48. Due to air being stopped from being introduced into the third chamber 50, the vacuum level in this chamber 50, which communicates with the second vacuum port 54 via the vacuum pipes 52*c* and 52*b*, is as high as $y_2$ which is close to the vacuum level $x_2$, shown in FIG. 2A, at the port 54. Due to the high vacuum in the third chamber 50, which communicates with the chamber 28 of the vacuum advancer 22, the vacuum force in the diaphragm 24 is high enough to cause the shaft 20 to move in the left-hand direction of FIG. 1 against the spring 26**. Therefore, when the auxiliary units are operating, the degree of advance of the ignition timing under the idle condition is as large as Rb shown in FIG. 2B, thus, causing the combustion efficiency of the engine to be increased. Due to such increased combustion efficiency, an idle rotational speed is sufficiently high enough to prevent phenomena such as "engine stall" or "over heating" from occurring, even when the load of the engine is high.

Figure 3:
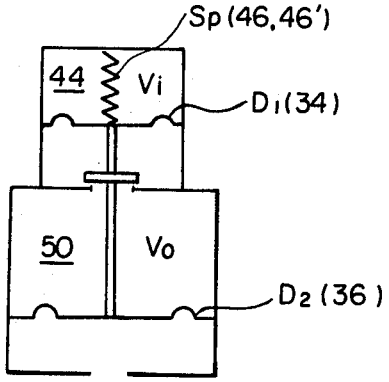
FIG. 3 is a schematic view of the modulator valve according to the present invention.

As is clear from the above description, when the engine is operating under the idle condition, the vacuum modulator 32 controls the vacuum level in the chamber 28 of the vacuum advancer 22 in such a manner that the vacuum level is reversely proportional to the vacuum level at the port 54 as shown by line L in FIG. 2A. The operation of the modulator 32 will now be illustrated with reference to FIG. 3. Referring to FIG. 3 which diagrammatically shows the modulator valve of the present invention, it is assumed that the pressure in the first chamber 44 is Vi, the pressure in the third chamber 50 is Vo, and the force of the springs 46 and 46' is Sp. Under an equilibrium condition, the sum of the upwardly directed vacuum force in the first diaphragm 34 of a diameter $D_1$ and that in the second diaphragm 36 of a diameter $D_2$ should be equal to the downwardly directed force Sp of the springs 46 and 46'. This equilibrium condition is represented by the following equation:

$$Vi \times D_1 + Vo \times D_2 = Sp \quad (1)$$

From this equation (1) is obtained the following equation:

$$Vo = Sp/D_2 - D_1/D_2 \times Vi \quad (2)$$

As shown by this equation (2), an inverse proportional relationship is maintained between Vi and Vo, which relationship corresponds to line L shown in FIG. 2A. In order to obtain a predetermined ignition timing characteristic curve M (FIG. 2B) for a particular distributor 18, the ratio $R_1/R_2$ and/or the force of the springs 46 and 46' should be appropriately selected.

Figure 7:
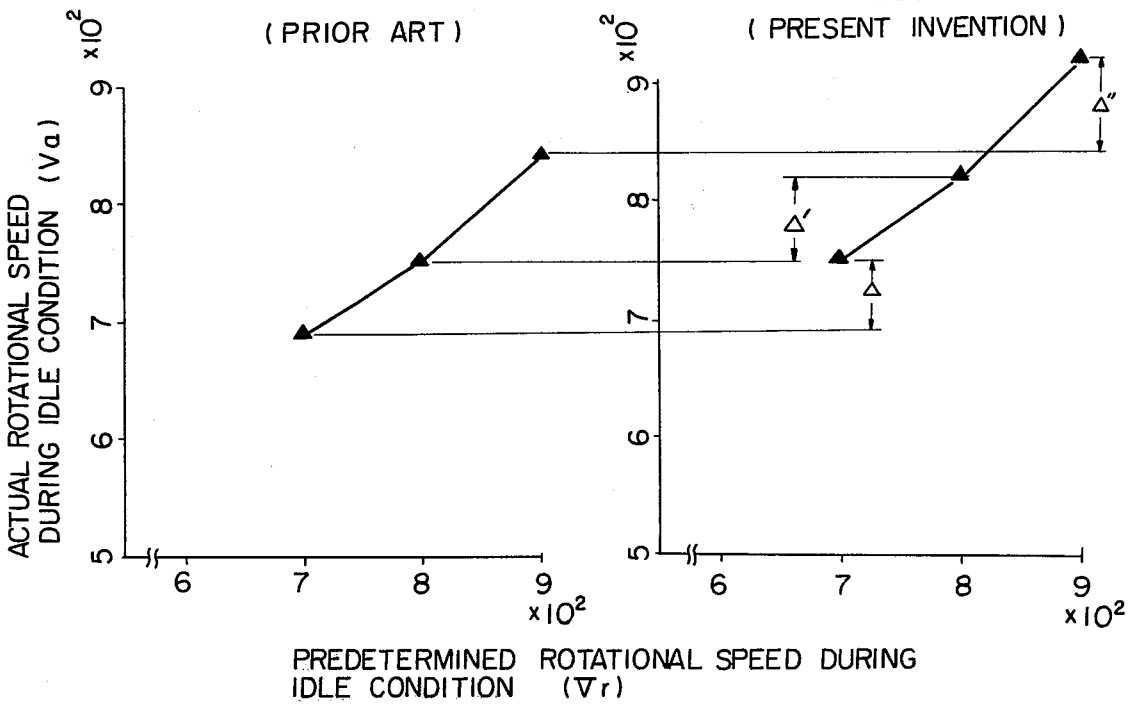
FIG. 7 show graphs of the effect of the present invention and the prior art.

FIG. 7 shows the effect of the present invention with respect to an engine which is provided with three types of auxiliary units, that is, an alternator, a power steering mechanism and a vehicle cooling device. In the graphs (a) and (b) shown in FIG. 7, the abscissa indicates a predetermined rotational speed Vr during the idle condition, whereas the ordinate indicates an actual rotational speed Va during the idle condition. In FIG. 7, graph (a) indicates the relationship between Vr and Va when an ignition timing control system of a known type is used, whereas graph (b) indicates the relationship between Vr and Va when the ignition timing control system shown in FIG. 1 provided with the vacuum modulator 32 according to the present invention is used. As is clear from FIG. 7, when the relationship (b) is compared with the prior art relationship (a), if the predetermined idle rotational speeds Vr are 700, 800 and 900 (r.p.m.), then increases of Δ, Δ' and Δ'' in the actual idle rotational speed of the engine are respectively obtained according to the present invention.

Normal Running Condition

When the throttle 16 is opened from the idle position so that the engine is operating under a normal running condition, the vacuum level at the port 54 communicating with the first chamber 44 of the modulator 32 is low enough to cause the diaphragm 34 to be displaced downwardly so as to cause the valve plate or member 42 to be seated on the valve seat 40. Thus, the third chamber 50 is disconnected from the air chamber 48 so that the vacuum level at the port 54 is always substantially equal to the vacuum level at the port 54. Therefore, the degree of advance of the ignition timing is controlled in accordance with the vacuum at the port 54 as shown by the dotted curve N in FIG. 2B. Thus, an ignition timing adapted to the normal running condition of the engine is obtained.

Figure 4:
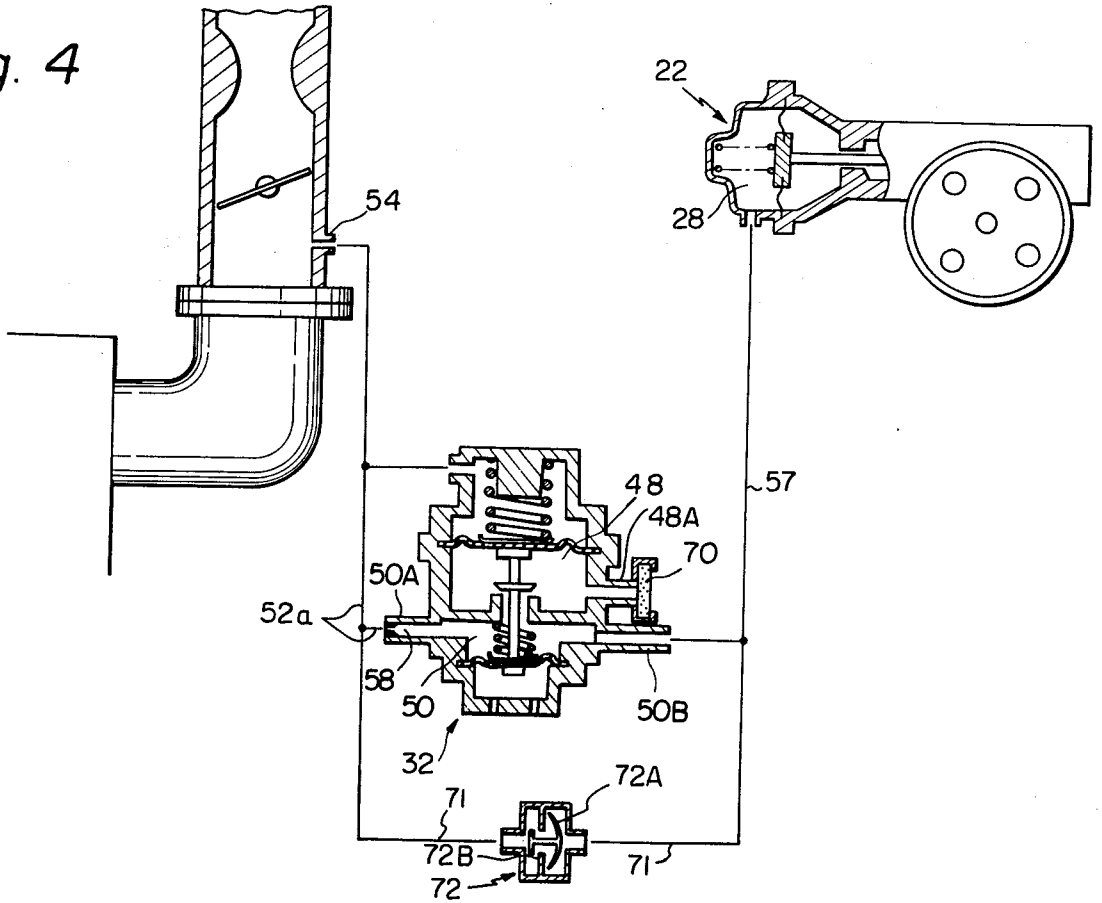
FIG. 4 is another embodiment of the present invention in which a check valve is used.

FIG. 4 indicates another embodiment of the present invention. The system shown in FIG. 4 is different from the system of FIG. 1 in that a separate air filter 70 is mounted on the air input port 48A of the vacuum modulator valve 32 in place of the vacuum line 53 for connecting the input port 48A with the advance port 30 in FIG. 1. Thus, the third chamber 48 is opened to the atmosphere via the air filter 70. The system in FIG. 4 is also different from the system in FIG. 1 in that a by-pass conduit 71 is provided for connecting the vacuum conduit 52c with the vacuum conduit 57. A check valve 72, which is comprised of a valve member 72 made of a resilient material and a valve seat 72B, is arranged on the by-pass conduit 71. This check valve 72 serves to stop the operation of the modulator valve 32 just when the throttle valve 16 begins to open from its idle position.

The operation of the system shown in FIG. 4 will now be described. When the engine is under an idle condition, a sufficiently strong vacuum is then formed at the port 54 for maintaining the valve member 72A to be rested on the valve seat 72B in order to prevent fluid from passing through the check valve 72. As can be seen from a comparison of the systems shown in FIGS. 1 and 4, the system of FIG. 4 substantially conforms to the system of FIG. 1. Therefore, atmospheric air introduced into the second chamber 48 via the air filter 70 is selectively introduced into the third chamber 50 for controlling the vacuum at the advance control chamber 28 of the vacuum advancer 22 to be reversely proportional to the vacuum pressure at the port 54, as shown by the curve L shown in FIG. 2A.

When the throttle valve 16 is opened from the idle position and the engine is thus running under a normal condition, the vacuum pressure at the port 54 is low enough to cause the valve member 72A to be detached from the valve seat 72B so as to allow fluid to pass freely through the check valve 72. Therefore, the chamber 28 of the vacuum advancer 22 is under a pressure which is substantially equal to the pressure at the port 54 just after the throttle valve 16 is opened from the idle position. Thus, control of the ignition timing of the engine in accordance with vacuum level at the port 54 is effected from the beginning of the opening of the throttle valve 16 in order to obtain an ignition timing of the engine adapted to the normal running condition of the engine. If the check valve 72 is not used as in the case of the embodiment shown in FIG. 1, the transmission of a vacuum signal from the port 54 to the chamber 28 of the vacuum advancer 22 is delayed due to the existence of the orifice 58. Therefore, for a period after the throttle valve begins to open, the ignition timing is not adapted to the normal running condition of the engine. It is, of course, possible to provide the check valve 72 in the embodiment shown in FIG. 1.

Figure 5:
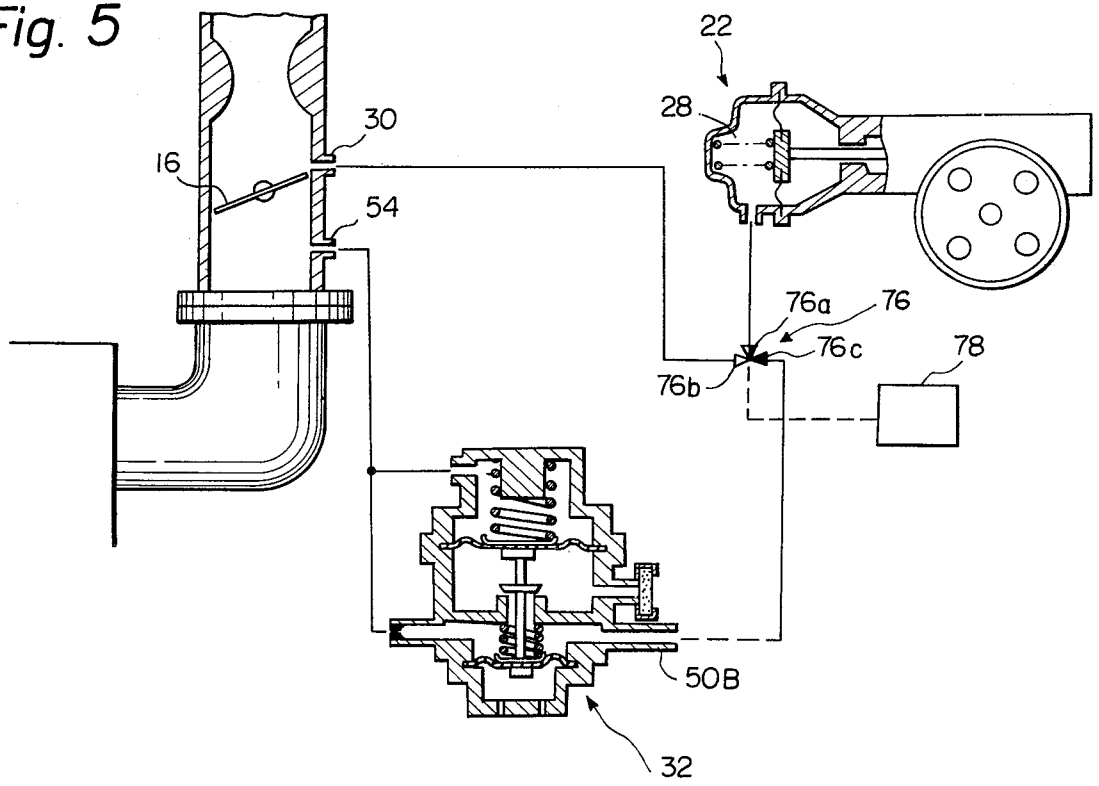
FIG. 5 is a further embodiment of the present invention in which an electromagnetic switching valve is used.

In another embodiment shown in FIG. 5, a vacuum switching valve 76, which is responsive to the idle condition of the engine for selectively connecting the vacuum advancer 22 with the second port 54 via the vacuum modulator 32 or with the advance port 30, is used. The vacuum switching valve 76 is an electromagnetic valve of a well-known type having three ports 76a, 76b and 76c. The common port 76a is connected to the chamber 28 of the vacuum advancer 22. The first switching port 76b is connected to the advance port 30, while the second switching port 76c is connected to the output 50B of the modulator 32. The electromagnetic valve 76 is connected to a mechanism 78 used for sensing the idle condition of the throttle valve 16. The mechanism 78 may comprise an electrical switch actuated by the motion of the throttle valve 16 or by the vacuum in the intake passageway for detecting the idle position of the throttle valve 16. The electrical switch is well known to those skilled in this art.

When the engine is under an idle condition, the mechanism 78 provides an electrical signal which is transmitted to the electromagnetic valve 76 to cause the valve 76 to attain a position wherein the common port 76*a* communicates with the switching port 76*c*. Thus, the chamber 28 of the vacuum advancer 22 communicates with the output 50B of the modulator 32. Therefore, as shown by the curve L of FIG. 2A, the modulator 32 controls the vacuum pressure in the chamber 28 so that the pressure is reversely proportional to the vacuum pressure at the port 54 as is already described with regard to FIGS. 1 and 5. Thus, control of the advance of the ignition timing during the idle condition according to the present invention is effected.

When the throttle valve 16 is moved from the idle position so that the engine is operating under a normal running condition, the mechanism 78 provides an electrical signal which causes the electromagnetic valve 76 to switch to another position wherein the common port 76*a* communicates with the first switching port 76*b*. Therefore, the chamber 28 of the advancer 22 is disconnected from the modulator 32 and then connected to the advance port 30. Therefore, the degree of advance of the ignition timing is controlled in accordance with the vacuum at port 54, as shown by the curve N in FIG. 2B. Thus, an ignition timing adapted to the normal running condition can be obtained.

Figure 6:
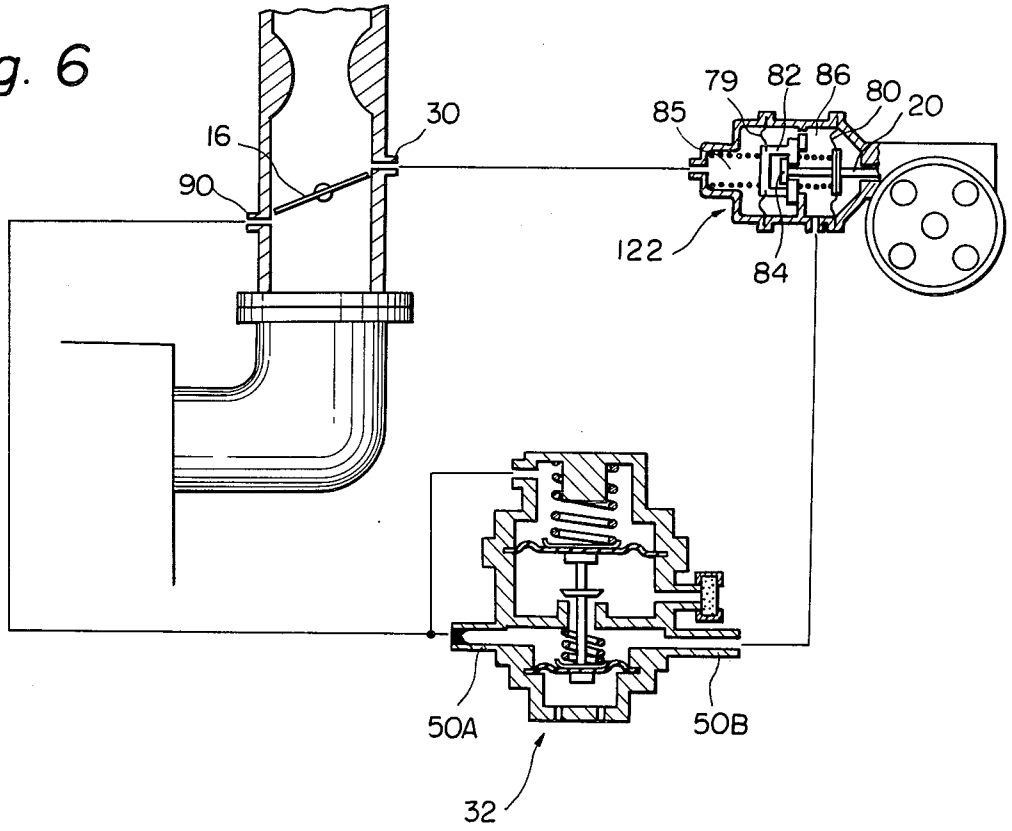
FIG. 6 is another embodiment of the present invention in which a vacuum advancer of the so-called double diaphragm type is used.

The embodiment shown in FIG. 6 is different from the embodiments of FIGS. 1, 4 and 5 in that a vacuum advancer 122 of the so-called double diaphragm type is utilized. This type of vacuum advancer, which is itself well known, comprises a first diaphragm 79 and a second diaphragm 80. The second diaphragm 80, which is connected to the advance control shaft 20, is connected to the first diaphragm 79 by a one-way clutch mechanism comprised of a clutch member 82 of a substantially C cross section connected to the first diaphragm 79 and also comprised of a stopper plate 84 connected to a free end of the shaft 20 so that the plate 84 is located in the clutch member 82. A first advance control chamber 85 is formed on one side of the first diaphragm 79, and is adapted to receive a vacuum signal from the advance port 30 for controlling the ignition timing during the normal running condition of the engine. A second chamber 86 is formed on one side of the second diaphragm 80, and is adapted to receive a vacuum signal from a vacuum port 90 formed in the carburetor barrel at a position slightly below the throttle valve 16 in its idle condition. Therefore, the vacuum in the second chamber 86 serves to control the ignition timing during the idle condition of the engine. In the embodiment shown in FIG. 6, for controlling the ignition time during the idle condition according to the principle of the present invention, the input 50A of the modulator 32 is connected to the second vacuum signal port 90 while the output 50B of the modulator is connected to the second vacuum control chamber 86 of the vacuum advancer 122.

Figure 2B:
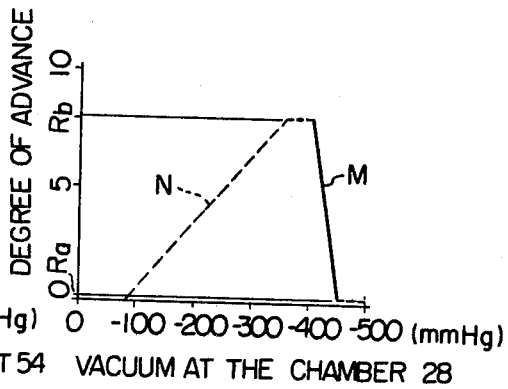
FIG. 2B is a graph showing the relationship between the vacuum level in the chamber 28 and the degree of advance of the ignition timing.

When the engine is operating under the idle condition, the second vacuum signal port 90 is under a vacuum pressure which causes a vacuum signal to be transmitted, via the vacuum modulator 32, to the second control chamber 86 of the vacuum advancer 122. Therefore, the vacuum level in this chamber 86 is controlled so that it is reversely proportional to the vacuum level at the port 90, similar to the condition shown by curve L in FIG. 2A. Thus, the control of the ignition timing as shown by the curve M in FIG. 2B is effected.

When the engine is operating under a normal running condition wherein the throttle valve is located downstream of the port 90 and upstream of the advance port 30, the advance port 30 is then caused to be under a vacuum pressure. As a result, a vacuum signal is transmitted to the first control chamber 85 of the vacuum advancer 122, causing the shaft 20 to be displaced in the left-hand direction of FIG. 6, since the clutch member 82 is engaged with the stopper plate 84. Therefore, an ignition timing adapted to the normal running condition is obtained. In this case, the second control chamber 86 of the vacuum advancer 122 is under a pressure which is near atmospheric pressure, since the second port 90 is located above the throttle valve 16.

While embodiments of the present invention are described with reference to the attached drawings, many modifications and changes can be made by those skilled in this art, without departing from the scope of the present invention.

What is claimed is:

1. An ignition timing control system for an internal combustion engine, said engine having an intake device provided with a throttle valve, said system comprising:

a distributor;

vacuum actuator means for operating said distributor;

a vacuum source formed in said intake device at a position located downstream of said throttle valve in its idle condition;

valve means having a casing, a pair of diaphragms arranged across the interior of said casing, a valve member connected to both said diaphragms, a valve seat arranged between said diaphragms so as to face said valve member, and spring means for urging said valve member so that said valve member is rested on said valve seat;

vacuum conduit means for introducing a vacuum signal from said vacuum source into a first chamber formed on one side of the first diaphragm remote from the second diaphragm;

an atmospheric pressure source connected to a second chamber formed between said first diaphragm and said valve seat;

second vacuum conduit means for introducing an input vacuum signal from said vacuum source into a third chamber formed between said valve seat and said second diaphragm; and third vacuum conduit means introducing an output vacuum signal from said third chamber into said vacuum actuator means, said second diaphragm forming, on one side remote from said first diaphragm, a fourth chamber which is always opened to the atmosphere, whereby the level of the vacuum in said third chamber is controlled by air introduced into said third chamber from said second chamber in response to the vacuum level in said first chamber and said third chamber.

2. An ignition timing control system according to claim 1, wherein said atmospheric pressure source comprises a vacuum port formed in said intake device of said engine at a position located slightly above said throttle valve in its idle condition.

3. An ignition timing control system according to claim 1, wherein said atmospheric pressure source comprises an air filter opened to the atmosphere.

4. An ignition timing control system according to claim 3, further comprising vacuum switching valve means which is responsive to a motion of said throttle valve, so that said vacuum actuator means is connected to said third vacuum conduit means when said engine is under said idle condition and said vacuum actuator means is connected to said vacuum port when said engine is under a running condition.

5. An ignition timing control system according to claim 1, wherein said vacuum actuator means is of such type that it includes, in addition to a main chamber for controlling ignition timing during the running condition of said engine, a supplementary chamber for controlling ignition timing during idle condition of said engine, said supplementary chamber being connected to said third vacuum conduit means, and wherein said vacuum source comprises a vacuum port formed in said intake device at a position slightly downstream of said throttle valve in its idle condition.

6. A spark ignition type internal combustion engine comprising:

an engine body;

an intake system provided therein with a throttle valve and connected to said engine body;

an exhaust system connected to said engine body;

a distributor a vacuum actuator having a shaft for operating said distributor, a spring-urged diaphragm connected to said shaft and a vacuum chamber formed on one side of said diaphragm;

a vacuum modulator valve having a casing, a pair of diaphragms arranged across the interior of said casing, a valve member connected to both said diaphragms, a valve seat arranged between said diaphragms so as to face said valve seat, spring means urging said valve member so that it is moved toward said valve seat, a first chamber formed on one side of the first diaphragm remote from said valve seat, a second chamber formed between said first diaphragm and said valve seat, a third chamber formed between said valve seat and said second diaphragm, and a fourth chamber formed on one side of said second diaphragm remote from said valve seat;

a first vacuum conduit means for connecting a vacuum port, formed in said intake system at a position slightly above said throttle valve in its idle condition, with said second chamber of said modulator valve;

a second vacuum conduit means for connecting another vacuum port, formed in said intake system at a position always located downstream of said throttle valve, with said first and said third chambers of said modulator;

an orifice arranged in said second vacuum conduit means for restricting the transmission of a vacuum signal from said other port into said third chamber; and a third vacuum conduit means for connecting said third chamber with said vacuum chamber of said vacuum actuator, said fourth chamber being always opened to the atmosphere.

7. An ignition control system according to any one of claim 1 through 5, further comprising an orifice means for controlling the rate of introducing a vacuum signal into said third chamber from said second vacuum conduit means.

8. An ignition control system according to any one of claim 1 through 6, further comprising another conduit means for connecting said second vacuum conduit means with said third vacuum conduit means and a check valve arranged in said other conduit means for stopping the operation of said modulator means by sensing a decrease in a vacuum level at said vacuum source when said throttle valve is opened from its idle condition.

* * * * *